United States Patent [19]

Frei

[11] 4,155,395

[45] May 22, 1979

[54] VENETIAN BLIND CONSTRUCTION

[75] Inventor: Paul Frei, Elgg, Switzerland

[73] Assignee: Griesser AG, Switzerland

[21] Appl. No.: 826,868

[22] Filed: Aug. 22, 1977

[30] Foreign Application Priority Data

Aug. 23, 1976 [CH] Switzerland ..... 10664/76
Jun. 15, 1977 [CH] Switzerland ..... 7340/77

[51] Int. Cl.[2] ..... E06B 9/262; E06B 9/303
[52] U.S. Cl. ..... 160/168 R; 160/178 R
[58] Field of Search ..... 160/166–178 R

[56] References Cited

U.S. PATENT DOCUMENTS 1,327,363 1/1920 Wilson et al. ..... 160/168
3,916,973 11/1975 Schuppler ..... 160/178 R

FOREIGN PATENT DOCUMENTS 2359762 7/1974 Fed. Rep. of Germany ..... 160/173

*Primary Examiner*—Peter M. Caun
*Attorney, Agent, or Firm*—McGlew and Tuttle

[57] ABSTRACT

A venetian blind comprises at least two spaced apart support cables and a plurality of slats disposed at spaced locations along the support cables and having respective front and rear edges which are respectively engaged for relative rotation on coupling heads for each edge of the slats mounted on the respective cables in pairs at spaced locations along the lengths thereof. The coupling head also has cable-engagement means in the form of a supporting ring which connects the coupling to the cable in a manner permitting relative rotation therebetween about an axis which is substantially at right angles to the axis of the pivoting of the slats. The construction includes fold-initiating means which are associated with the cables between the coupling heads and which are effective to fold the cables in a preselected fold intermediate the lengths of the cables between the coupling head.

6 Claims, 16 Drawing Figures

Fig 13
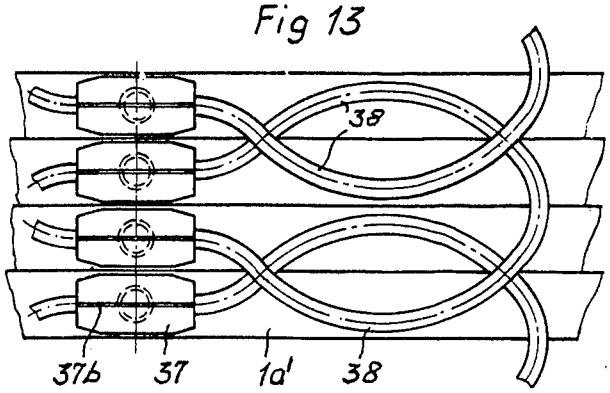
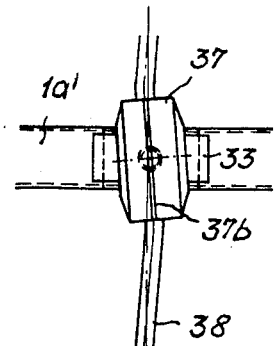
Fig.14
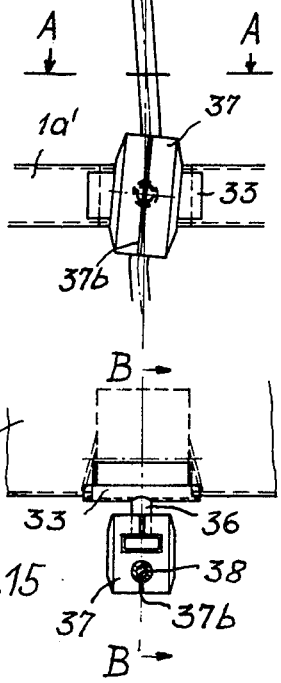
Fig.15
Fig.16
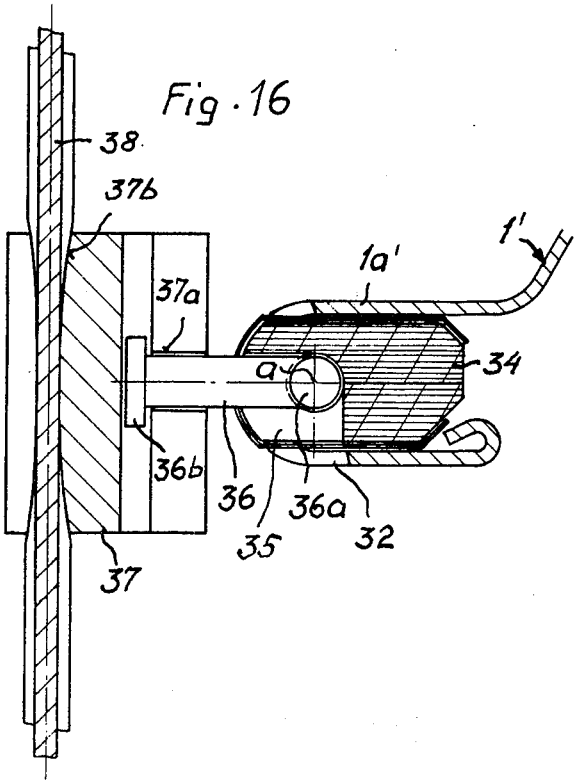

VENETIAN BLIND CONSTRUCTION

FIELD AND BACKGROUND OF THE INVENTION

This invention relates in general to venetian blind constructions and, in particular, to a new and useful venetian blind which is provided with tension members acting from below to lift and lower the blind and with supporting members by which the slats are connected to one another.

DESCRIPTION OF THE PRIOR ART

Venetian blinds of this kind are well-known. Their supporting members make it possible to slant the slats as the blind is lowered and, at the same time, to ensure the provided spacing of the slats. Most of the known blinds of this kind comprise supporting members in the form of so-called ladder-type bands or cords made of textile material in which each slat is supported by two cross-members forming ladder rungs. Such designs have the advantage that the completely supple bands or cords require little space and can be easily gathered, but on the other hand, they may pass between the slats in a disturbing manner since their direction of folding during the gathering cannot be exactly predetermined. In addition, they are exposed to relatively strong wear, particularly due to the unavoidable shifting of the slats on the ladder rungs during slanting.

For this reason, in other designs of venetian blinds, supporting members have been provided which comprise rigid, one- or two-armed levers which are hinged to each other and are accommodated in guide casings laterally of the space occupied by the slats. The members act on cross-pieces carried by the end pins of the slats and, during gathering, they fold transversely to the plane of the blind. This design requires not only a large amount of material and space, but it is not applicable to relatively wide window openings since the large span of the supporting members permits sagging of the slats.

SUMMARY OF THE INVENTION

The present invention is directed to a venetian blind which is equipped with supporting members having neither the disadvantage of an uncontrollable flexibility and susceptibility to wear of textile supporting members, nor of requiring a large amount of material and space and of the inability of mounting them within the area occupied by the slats of the blind.

In accordance with the invention, the supporting members comprise strands of metal wire or cables which impart a rotary motion at equally spaced locations and in a plane parallel to the plane of the blind to coupling heads which are hinged to the edge of the respective slat and are also pivotable in a vertical plane perpendicular to the plane of the blind, and the strand sections extending between successive coupling heads include a folding portion which is provided midway of the strand section and allows the section to fold alternately to one side or the other, through approximately 180° and in a plane parallel to the plane of the blind.

Since the mounting of the strands, which are advantageously made of metal wire and thus of a relatively rigid material, as well as the folding portion of the strand sections extending between the slats, provide a rotation or folding in a plane which is parallel to the plane of the blind, it is ensured that during the gathering of the blind, the strands which are stretched and extend vertically with the blind lowered will fold by portions and in the mentioned plane, alternately to one side and the other side, without penetrating between the slats in an undesirable manner. The slant of the slats may be adjusted, in a simple manner, by a vertical relative displacement of the strands, and this adjustment is effected due to the hinged connection of the coupling heads without any interfering contact between the strands and the slats and with substantially no friction. The slats are advantageously designed with beaded edges.

In practice, two embodiments of the supporting members have proven to be particularly advantageous. In one of these embodiments, each strand comprises a continuous wire rope or cable which is secured to the coupling heads by means of a ring mounted on a pivot portion of the head, while each folding portion of the rope is formed by a prefolded length of the rope section extending between two neighboring coupling heads, with a clamping sleeve pressed thereon. In the other embodiment, each strand comprises individual spring wire lengths which are rotatably looped to both the coupling heads and to connecting members which serve as folding members.

As mentioned, supporting members of wire ropes have proven to be particularly advantageous. However, the relative rigidity by such wire ropes may cause difficulties, for example, if during the gathering, the head portions secured thereto do not turn into a uniform horizontal position, or if adjacent loops interfere with each other, in both such instances, the result may be that the slats will fail to closely abut each other.

Therefore, the purpose of the present invention is also to provide a venetian blind of the mentioned kind in which these difficulties are avoided. To this end, the metal wire strands formed by wire ropes are clamped into a frontal groove of a head part of the coupling heads and the rope section extending between two consecutive coupling heads is slightly deformed by bending in advance in the direction of loop formation both immediately at its exit from the coupling head and in the mid-section.

This preliminary bending of the wire ropes, which, with the blind lowered, thus with stretched wire ropes, is manifest only as a relatively slight permanent deformation in the wire rope, effecting a slightly inclined position of the coupling head parts engaged thereon, has the effect that during the gathering of the blind, the rope sections are not bent to U-shaped or V-shaped loops in which the leg portions would spread and tend to move the coupling heads and, thereby, the slats, apart and thus counteract the gathering, but they are bent to rounded loops (approximately of the shape of a tennis racket), the leg end portions of which, received in the head portions tend to get themselves and thereby these head parts into a parallel position to each other.

It has been further proved particularly advantageous to provide the wire ropes with a coating of plastic. This may not only stabilize the bend produced, for example, by a preliminary buckling of the wire rope, but may also improve the elasticity of the wire rope. In this way, rupture of individual wires is prevented and the risk of fouling and corrosion of the rope is reduced.

In addition, due to the preliminary bending, the relatively bulgy loops overlap at the beginning of the gathering and cannot hinder each other, whereby, a satisfactory gathering of the slats up to their complete juxtaposition is ensured.

In order to make certain that the head parts which are secured to the ropes move into the transverse position, in which they are parallel to each other, the smooth function of the hinges of the coupling head is particularly important. In this respect, a particularly advantageous embodiment has been found in which a bearing body of plastic, preferably of a polyamide, is inserted in the beaded edge of the slat, and it is provided with a coupling bolt. One end of the bolt extends into the bearing body and carries a cross-pin which is mounted to swivel in the bearing body in a plane perpendicular to the plane of the blind, and the other end of the bolt projects from the beaded edge of the slat and carries a head part which is secured to the wire rope and mounted on the bolt for rotation in a plane parallel to the plane of the blind.

Accordingly, it is an object of the invention to provide an improved venetian blind which is extendible into a covering position and may be gathered into an uncovering position, which comprises at least two spaced apart cables and a plurality of coupling heads pivotally mounted along each of the cables and a plurality of slats transversely disposed between the spaced apart cables and pivotally mounted to pairs of the coupling heads for pivotal movement about an axis at an angle to the coupling head and which further includes a plurality of folding means connected to the cables at locations between the coupling heads for folding the cables in a selected and uniform manner when the venetian blind is gathered into its own covering position.

A further object of the invention is to provide a venetian blind which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

BRIEF DESCRIPTION OF THE DRAWINGS

In the Drawings:

FIG. 13 is a partial view of a gathered blind of another embodiment of the invention;

FIG. 14 is a partial view of the lowered blind of FIG. 13;

FIG. 15 is a horizontal sectional view taken along the line A—A of FIG. 14; and FIG. 16 is an enlarged vertical sectional view taken along the line B—B of FIG. 15.

DESCRIPTION OF THE PREFERRED EMBODIMENTS

Figure 1:
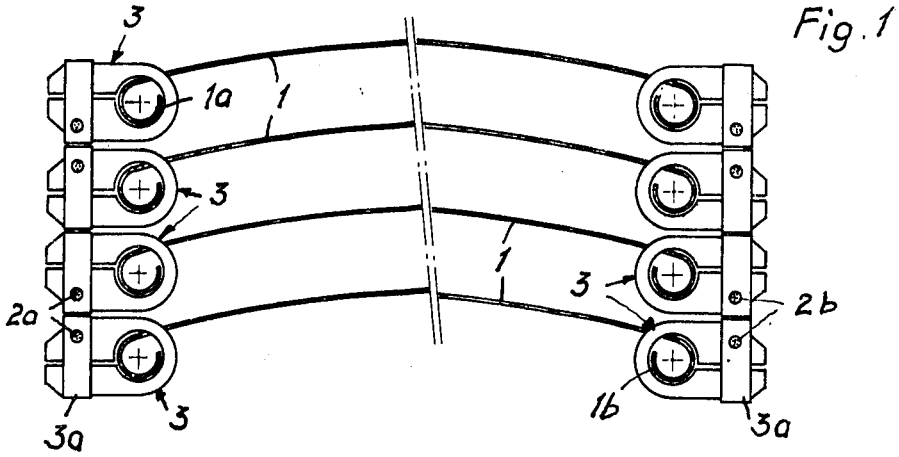
FIG. 1 is a front to rear partial elevational and partial sectional view of a venetian blind constructed in accordance with the invention.
Figure 2:
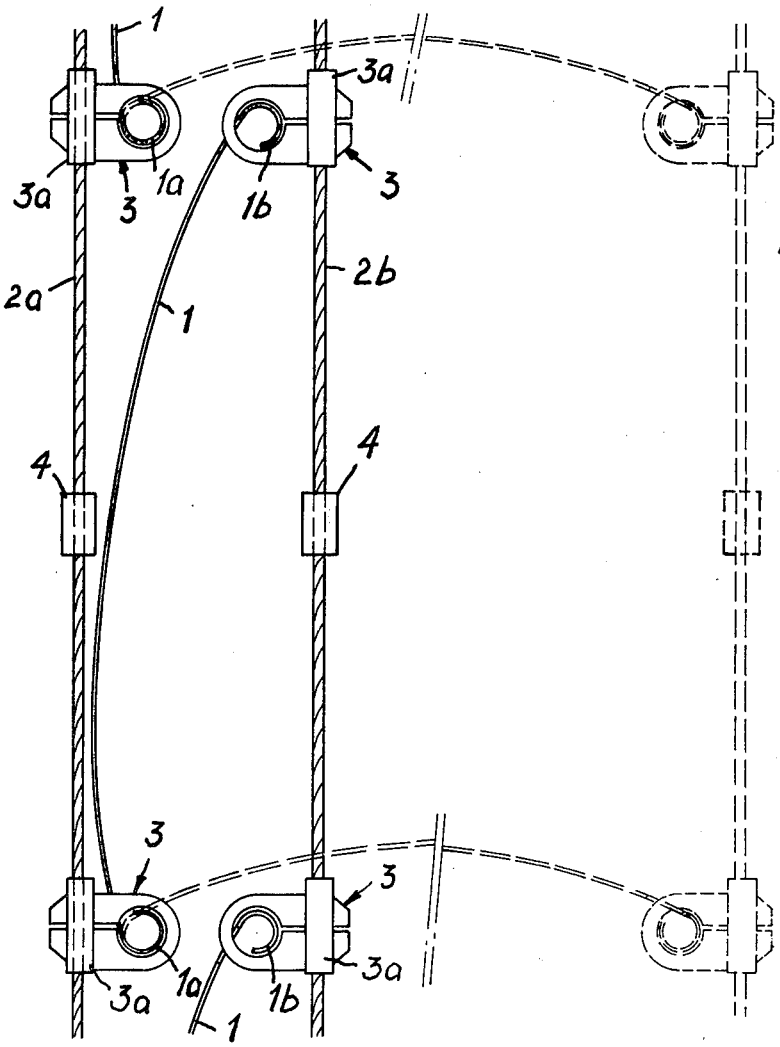
FIG. 2 is a view similar to FIG. 1 indicating both the shifting of the slats from a solid line covering position to a dotted line uncovering position.

Referring to the drawings in particular, the invention embodied therein, comprises as broadly shown in FIGS. 1 and 2, a venetian blind which is provided with tension members which act from below to lift and lower the blind and with supporting members connecting slats 1 to one another, the supporting member comprising wire ropes, cables or strands 2*a* and 2*b* which are arranged in spaced locations in a plane parallel to the plane of the blind. Rotary motion is imparted to coupling heads 3 arranged at spaced locations along the lengths of the cables 2*a* and 2*b*, and are hinged to the respective front and rear edge 1*a* and 1*b* of each blind slat 1. The strand or cable sections 2*a* and 2*b* which are located between adjacent coupling heads 3, 3 are provided with fold-initiating means 4 which make possible, for example, a preselected folding, such as an alternate folding, of the strand sections to one of the other sides for approximately 180° in a plane which is parallel to the plane of the blind slats 1.

Slats 1 of the embodiments shown in FIGS. 1 to 6 are connected to each other, within their longitudinal extension, by supporting members which comprise two each, spaced apart wire ropes or cables 2*a* and 2*b*, leading upwardly to a slanting device (not shown) which permit a vertical displacement of the two ropes. Each of the ropes 2*a* and 2*b* is fixed, at locations spaced in accordance with the desired spacing of the slats, in cable engagement means in the form of an eccentric segment bore of a supporting ring 3*a* which is mounted on a longitudinally slit pivot 3*b* of a coupling head 3. The pivot 3*b* is provided with a projecting eye 3*c* with a bore 3*d* which serves as a hinge seat for the beaded edge 1*a* or 1*b* of a respective slat 1. Since the axis of bore 3*d* extends perpendicularly to the axis of pivot 3*b*, the pivotal planes of supporting ring 3*a* and of slat 1 are also perpendicular to each other, i.e., the supporting ring and, thereby, the rope portions fixed therein, are pivotable (to a limited extent) in a plane which is perpendicular to the plane of the blind.

Figure 3:
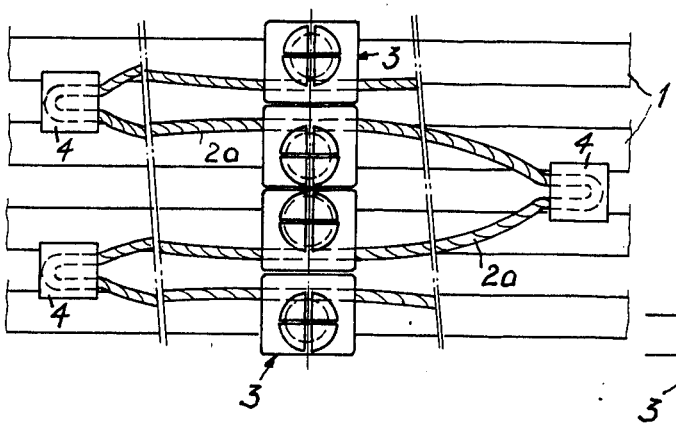
FIG. 3 is a partial front elevational view of the gathered blind shown in FIG. 1.
Figure 4:
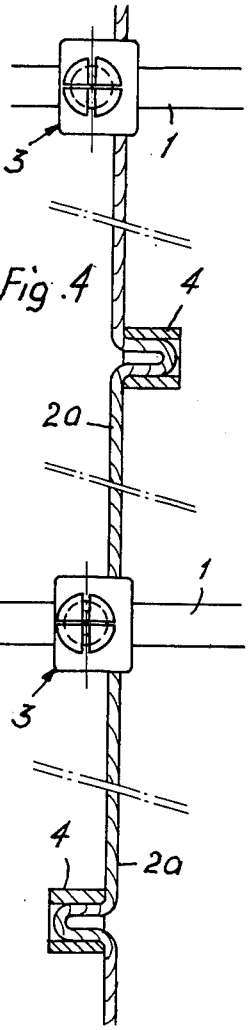
FIG. 4 is a front view of the lowered blind shown in FIG. 3.
Figure 5:
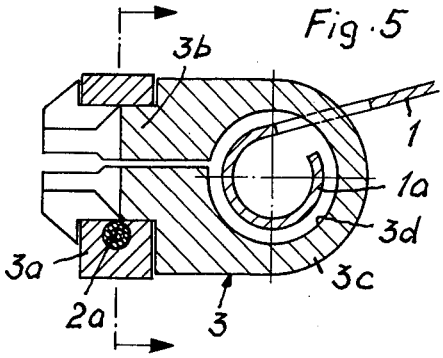
FIG. 5 is an enlarged sectional view of a coupling head used in the embodiments of FIGS. 1 through 4.
Figure 6:
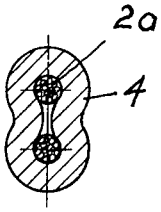
FIG. 6 is an enlarged sectional view of a clamping sleeve of the type shown in FIGS. 1 to 4, providing a folding member.

In accordance with the invention, the rope sections extending between two successive slats 1 or coupling heads 3 are provided, in the midst of their length, with fold-initiating means comprising a clamping sleeve 4 by which a 180° fold of the rope section, pointing alternately to the one or the other side in the longitudinal direction of slats 1, is fixed. With the blind lowered, the two wire ropes 2*a*, 2*b* of the supporting member are stretched and supporting ring 3*a* of each of the coupling heads 3 is turned so that the segment bores of all heads are vertically aligned with one another (FIGS. 2 and 4). While gathering the blind by means of a control member (not shown) acting against a bottom bar or against the lowermost slat (for example, a band, rope, or chain), the rope sections extending between the consecutive slats 1 fold in the direction predetermined by clamping sleeves 4 and into an approximately horizontal position, as shown in FIG. 3 while, at the same time, supporting rings 3*a* are turned through 90°, so that the segment bores of these rings and, thereby, the rope portions retained therein, now extend horizontally, i.e., with the blind gathered.

Due to the limited flexibility of the wire rope and the predetermined direction of rotation or folding, all rope sections necessarily extend off of the slats, and in a plane which is parallel to the plane of the blind. This securely prevents a disturbance in the gathering of the blind. If the slats are slanted by a vertical relative displacement of the two ropes, any friction between slat and rope is avoided, due to the seating of the slat edges in eyes 3*c* of the coupling heads, so that wear or fatigue phenomena on the rope, such as are usual with textile supporting members, are absent.

Figure 7:
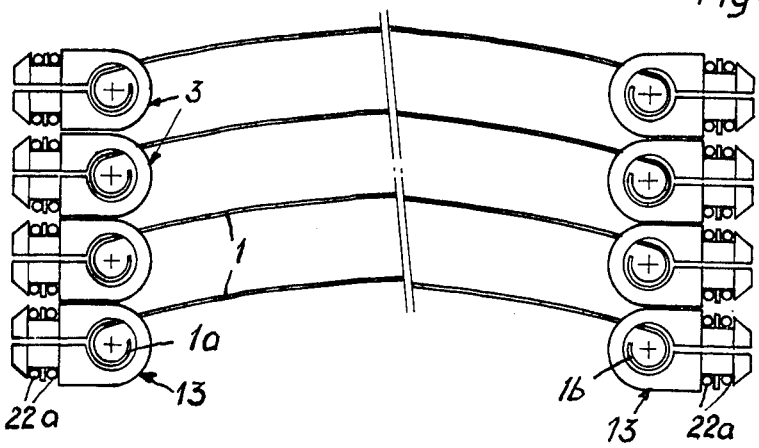
FIG. 7 is a view similar to FIG. 1 of another embodiment of the invention.
Figure 8:
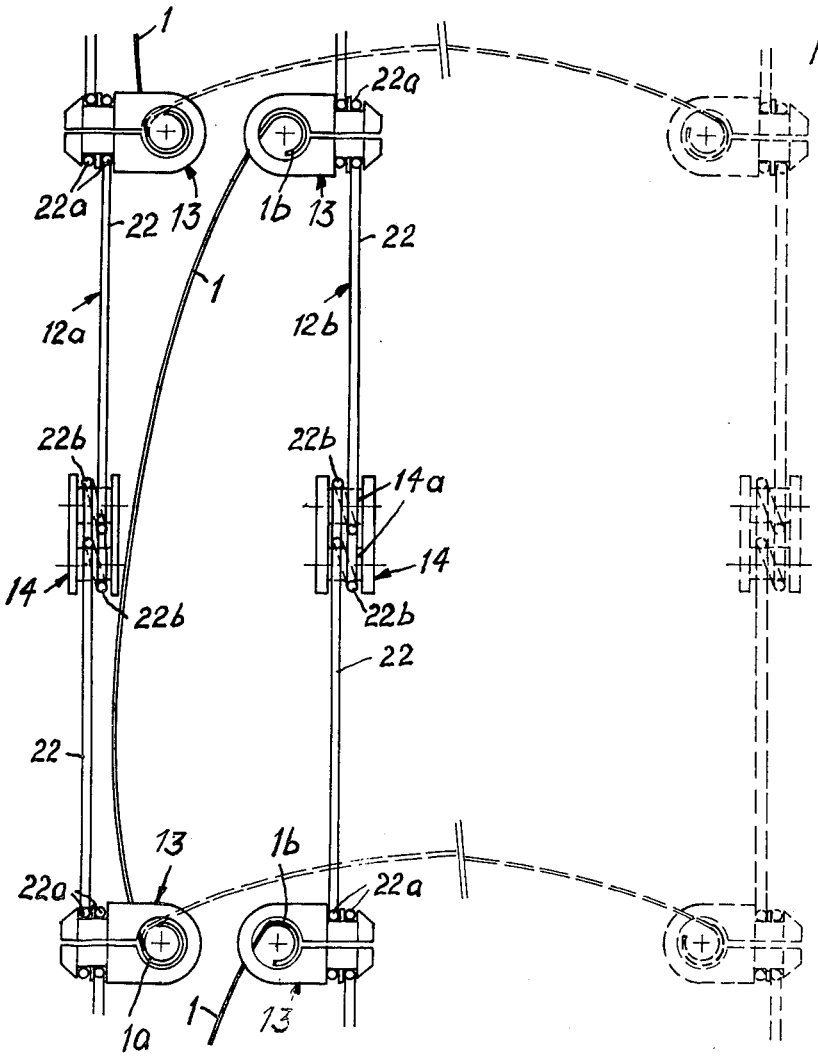
FIG. 8 is a view similar to FIG. 2 of a blind according to the construction of FIG. 7.
Figure 9:
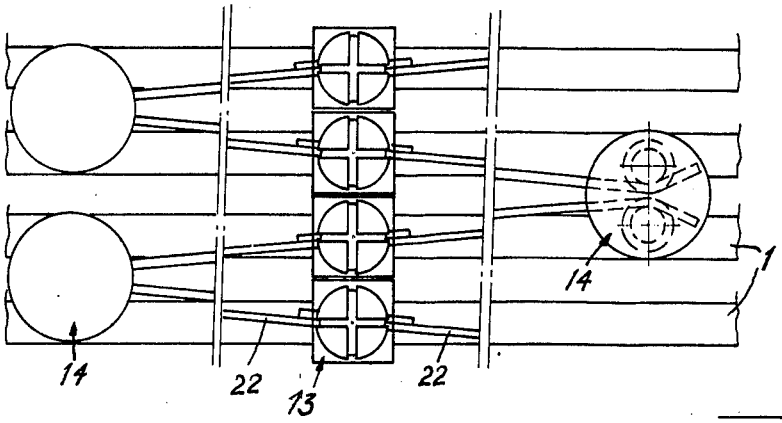
FIG. 9 is a front view similar to FIG. 3 of the blind shown in FIG. 7.
Figure 10:
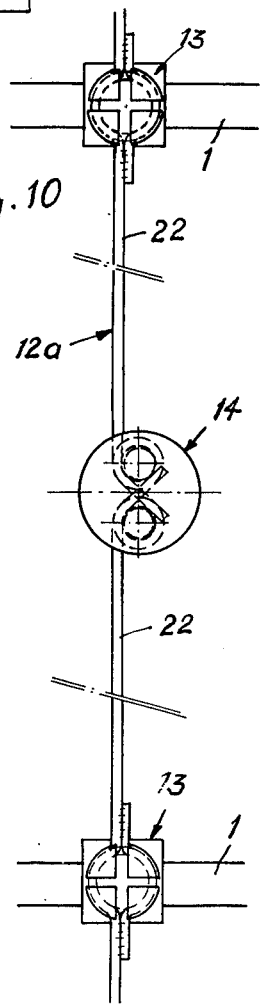
FIG. 10 is a front view similar to FIG. 4 of the blind of FIG. 8.
Figure 11:
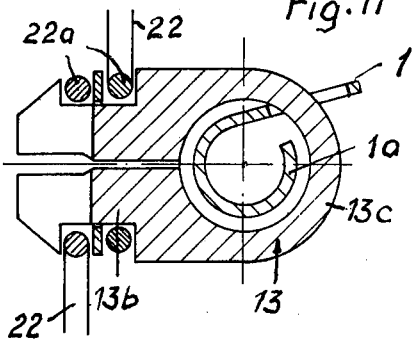
FIG. 11 is an enlarged sectional view of a coupling head of the embodiment according to FIGS. 7 through 10.
Figure 12:
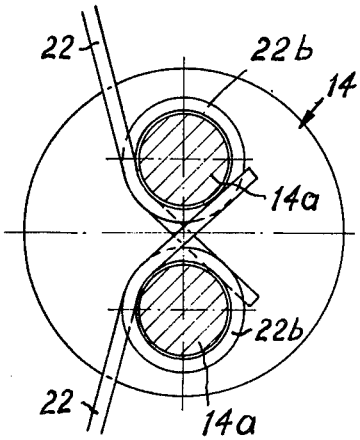
FIG. 12 is an enlarged sectional view of a connecting element serving as a folding member.

In the second embodiment shown, as seen in FIGS. 7 to 9, each supporting member also comprises two continuous metal strands or cables 12 and 12*b*. However, as shown in FIGS. 8 and 10, these strands are assembled of individual, uniform wire springs 22 and are connected to each other, as will be described hereinafter, by coupling heads 13 and by connecting elements 14 intended as folding members or fold-initiating means, each to a composite metal wire strand. On one of the ends of wire springs 22, there is provided a closed loop 22*a* by which they are mounted side-by-side on a pivot 13*b* of coupling head 13 (incidentally, this corresponds to the design of the first embodiment), while on their other end which, with the blind lowered, is in a position intermediate two neighboring slats 1, each wire spring 22 is provided with a ring loop 22*b* having a projecting end portion. These ring loops 22*b* of two adjacent wire springs 22 are each mounted on one of two parallel pins 14*a* of a connecting element 14 serving as a folding member. They are mounted in a manner such that, with the blind lowered, the projecting end portion of loop 22*b* of one of wire springs 22 abuts against the pin 14*a* carrying the loop 22*b* of the other wire spring 22. It is thereby obtained that while gathering the blind, the two wire springs 22 connected to each other by the connecting element 14 are each rotated through approximately 90°, in a plane which is parallel to the plane of the blind and only in the direction opposite to the projecting end portions of loops 22*b*, i.e., the strand section formed by these wire springs is folded in the midst of its length approximately through 180°, while ring loops 22*a* on the coupling head turn in a direction such that the strand sections between the slats are folded alternately to the one side and to the other side, into an approximately horizontal position. Here again, as described above, the beaded slat edges 1*a*, 1*b* seated in the eyes of coupling heads 13 permit a slanting of the slats in a lowered blind, as shown in FIG. 8.

In the embodiment of FIGS. 13 to 16, slats 1′ are again provided, and are comprised of shaped metal sheets having longitudinal beaded edges 1*a*. A bearing body 34 of plastic is inserted through a recess 32 in beaded edge 1*a*′ and is received in a steel sleeve 33. In the zone of edge recess 32, steel sleeve 33 and bearing body 34 are provided with a segmental recess 35 which extends through about 90° relative to the central longitudinal axis a of beaded edge 1*a*′. A recess 35 is provided in the rear beaded edge of the slat (FIG. 16), in the lower quadrant, and in the front beaded edge of the slat, in the upper quadrant.

A cross-pin 36*a* of a pivot pin 36 projecting from beaded edge 1*a* through recess 35 is mounted in bearing body 34 for swiveling about axis a. The pivoting angle of pivot pin 36 which extends in a vertical plane perpendicular to the plane of the blind, is limited by recess 35. The end portion of pivot pin 36 projecting from the beaded edge is mounted for rotation in a bore 37*a* of a clamping part 37 and secured against axial displacement by a head 36*b* which extends in a recess of this clamping part. At the side opposite to bore 37*a* of clamping part 37, the clamping part is provided with a slot 37*b* extending perpendicularly to the plane formed by axis a of cross-pin 36*a* and axis b of pivot pin 36. The associated wire rope 38 of the supporting member is clamped in this slot 37*b*.

Wire rope 38 is provided with a coating of plastic which prevents rope 38 from being damaged during clamping by the squeezing of portions of the clamping part by which slot 37*b* is formed. At the same time, the coating not only increases the stiffness of the wire rope but also provides a quite satisfactory protection against corrosion and, due to its smooth surface, makes it difficult for dirt to deposit on the wire rope.

As shown in FIG. 4, the rope sections extending between two coupling heads are advantageously slightly bent in advance in the direction of the loop formation by buckling both at the exit points at head parts 37, and in the midst of their lengths to form fold-initiating means. With the blind lowered, this results in a slightly zig-zag shape (exaggerated in the drawing) of rope 38 and a slightly inclined position of the coupling head part 37 secured thereto.

The lifting of a slat 1 for gathering the blind has the effect of an instant formation of a loop in the desired direction and, in addition, the formed loop is relatively rounded and the leg portions of the loop transmit only a small spreading force to the coupling heads or the slats which is easily overcome by the pull on the blind control line. Consequently, slats 1 can be completely gathered to a full abutment, while coupling head parts 37 acting on the rope come into a transverse position. The described coupling heads have smoothly operating joints and can be easily mounted.

In all of the examples, the supporting members are made of relatively thin wire strands and can be easily disposed within the longitudinal extension of a blind, since their folding during gathering of the blind in a plane parallel to the plane of the blind is predetermined and, therefore, permits manufacture of blinds of any width.

While specific embodiments of the invention have been shown and described in detail to illustrate the application of the principles of the invention, it will be understood that the invention may be embodied otherwise without departing from such principles.

What is claimed is:

1. A venetian blind extendible into a covering position and gatherable into an uncovering position, comprising at least two cables spaced from each other, a plurality of coupling heads connected to each of said cables at spaced locations along the length thereof and supporting said cables for rotation relative to said coupling heads about a first axis, a plurality of slat members transversely disposed between said spaced cables and pivotally mounted to respective pairs of said coupling heads, the pivotal axis of said slats in respect to said coupling heads being at an angle to that of said coupling head pivoting in respect to said cables, and a plurality of folding means connected to said cables at locations between said coupling heads for folding said cables in a selected and uniform manner when the venetian blind is gathered into its uncovering position, each of said coupling heads including a bearing ring connected to said cables and pivotally mounted on said coupling head, said coupling head further including a projecting eye spaced from said bearing ring, said slat members including a beaded formation at each edge, each engageable into a respective eye of said coupling head of the associated cable.

2. A venetian blind, according to claim 1, wherein each of said folding means comprises a clamping sleeve connected to said cable, for retaining a crimp in said cable for biasing said cable to fold in a selected direction when the venetian blind is gathered into its uncovering position.

3. A venetian blind comprising at least two spaced apart metal support cables, a plurality of slats disposed at spaced locations along said metal support cables and having respective front and rear edges, a coupling head for each edge of said slats on respective cables arranged in pairs at spaced locations along the length of the respective cables, a respective edge of said slats being rotatably supported in each respective coupling head for rotation about a first axis, cable engagement means on said coupling head connecting said coupling head to said cable in a manner permitting relative rotation therebetween about a second axis at substantially right angles to said first axis, and fold initiating means associated with said cables between said coupling heads effective to fold said cables in a preselected fold intermediate the length of said cables between said coupling head, said metal support cables comprising wire springs, each including a closed wire loop, a connecting member between adjacent springs and located between adjacent coupling heads, each adjacent spring having a loop engaged around said connecting member.

4. A venetian blind comprising at least two spaced apart metal support cables, a plurality of slats disposed at spaced locations along said metal support cables and having respective front and rear edges, a coupling head for each edge of said slats on respective cables arranged in pairs at spaced locations along the length of the respective cables, a respective edge of said slats being rotatably supported in each respective coupling head for rotation about a first axis, cable engagement means on said coupling head connecting said coupling head to said cable in a manner permitting relative rotation therebetween about a second axis at substantially right angles to said first axis, and fold initiating means associated with said cables between said coupling heads effective to fold said cables in a preselected fold intermediate the length of said cables between said coupling head, said coupling head including a part having a longitudinal slot in which said metal support cable is supported, said fold initiating means comprising lengths of said cable between said coupling heads which are bent in a folding direction in advance in a direction of the desired loop formation, said fold initiating means further comprising a clamping sleeve holding said lengths of the metal cables between said coupling heads in said bent condition.

5. A venetian blind comprising at least two spaced apart metal support cables, a plurality of slats disposed at spaced locations along said metal support cables and having respective front and rear edges, a coupling head for each edge of said slats on respective cables arranged in pairs at spaced locations along the length of the respective cables, a respective edge of said slats being rotatably supported in each respective coupling head for rotation about a first axis, cable engagement means on said coupling head connecting said coupling head to said cable in a manner permitting relative rotation therebetween about a second axis at substantially right angles to said first axis, and fold initiating means associated with said cables between said coupling heads effective to fold said cables in a preselected fold intermediate the length of said cables between said cupling head, said coupling head including a part having a longitudinal slot in which said metal support cable is supported, said fold initiating means comprising lengths of said cable between said coupling heads which are bent in a folding direction in advance in a direction of the desired loop formation, said part having a longitudinal slot coprising a block having a bore therethrough forming a portion of said slot through which the cable extends with a narrow diameter portion for clamping against said cable, a pivot pin rotatably supported on said block extending perpendicular to the slot, a cross-pin on an outer end of said pivot pin, said coupling head including a portion pivoted on said pivot pin and holding said slat.

6. A venetian blind, according to claim 5, wherein said slat includes an edge with a steel sleeve having a bearing body of plastic therein, said slat having a slot in which said sleeve is inserted, said bearing body having a recess, a pivot pin pivotable in said recess in a vertical plane perpendicular to the plane of said blind.

* * * * *